US012507808B2

(12) United States Patent
Pao

(10) Patent No.: US 12,507,808 B2
(45) Date of Patent: Dec. 30, 2025

(54) FOLDABLE CHAIR

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 118 days.

(21) Appl. No.: 18/352,367

(22) Filed: Jul. 14, 2023

(65) Prior Publication Data

US 2024/0041217 A1 Feb. 8, 2024

(30) Foreign Application Priority Data

Aug. 2, 2022 (TW) ..... 11112895.8

(51) Int. Cl.
*A47C 9/10* (2006.01)

(52) U.S. Cl.
CPC ..... *A47C 9/105* (2013.01)

(58) Field of Classification Search
CPC ..... A47C 9/105
USPC ..... 108/118; 297/16.1, 16.2, 23
See application file for complete search history.

(56) References Cited

U.S. PATENT DOCUMENTS

| | | | | |
|---|---|---|---|---|
| 8,876,203 | B1 * | 11/2014 | Haertl | A47C 4/04 297/29 |
| 8,997,766 | B2 * | 4/2015 | Pao | A47C 4/04 297/16.2 |
| 9,504,297 | B2 * | 11/2016 | Pao | A47C 4/04 |
| D894,585 | S * | 9/2020 | Ye | D3/7 |
| 11,700,946 | B2 * | 7/2023 | Pao | A47C 9/105 297/16.2 |
| 2014/0034097 | A1 * | 2/2014 | Pao | A45B 5/00 135/66 |
| 2015/0196103 | A1 * | 7/2015 | Pao | A47C 9/105 297/55 |
| 2017/0086542 | A1 * | 3/2017 | Pao | A45B 5/00 |
| 2022/0061535 | A1 * | 3/2022 | Pao | A45B 5/00 |

FOREIGN PATENT DOCUMENTS

| | | |
|---|---|---|
| TW | I483694 | 5/2015 |

* cited by examiner

*Primary Examiner* — Jose V Chen
(74) *Attorney, Agent, or Firm* — Burris Law, PLLC

(57) ABSTRACT

A foldable chair includes a support unit, a sliding base, and a seat unit. The support unit includes a pivot base, a main support rod and two auxiliary support rods connected to the pivot base. The sliding base is sleeved on the main support rod. The seat unit includes a seating subunit connected to the sliding base. The seat unit further includes a linkage subunit that includes a first linkage rod connected to the pivot base, a second linkage rod connected to the first linkage rod and the sliding base, and a resilient member between the pivot base and the first linkage rod. The seating subunit is convertible between a folded state and an expanded state. The resilient member biases the end of the first linkage rod distal from the pivot base away from the main support rod.

8 Claims, 10 Drawing Sheets

FOLDABLE CHAIR

CROSS-REFERENCE TO RELATED APPLICATION

This application claims priority to Taiwanese Invention Patent Application No. 111128958, filed on Aug. 2, 2022.

FIELD

The disclosure relates to a chair, and more particularly to a foldable chair.

BACKGROUND

Referring to FIG. 1, a conventional foldable chair according to Taiwanese Patent No. 1483694 includes a supporting unit 11, a folding unit 12, and a seat unit 13. The supporting unit 11 has a mounting rod 111. The folding unit 12 includes a positioning base 121 that is sleeved on the mounting rod 111, an upper slide base 122 that is slidably sleeved on the mounting rod 111 and located above the positioning base 121, and two folding rods 123 that are pivotally connected to the positioning base 121. The seat unit 13 includes a main seat segment 131, two lateral seat segments 132 that are respectively and pivotally connected to opposite lateral ends of the main seat segment 131, and two guide rails 133 that are respectively connected to the lateral seat segments 132. Each of the two folding rods 123 has a top end that slidably engages a respective one of the two guide rails 133. Each of the guide rails 133 has an expanded end point 134 and a collapsed end point 135. When the upper slide base 122 is operated to slide along the mounting rod 111, the seat unit 13 and the folding unit 12 may be moved relative to the supporting unit 11 between an expanded state and a folded state. When the seat unit 13 and the folding unit 12 are in the expanded state, as shown in FIG. 1, the top ends of the folding rods 123 are away from the mounting rod 111. More specifically, when the seat unit 13 and the folding unit 12 are in the expanded state, the top ends of the folding rods 123 are respectively positioned at the expanded end points 134 of the guide rails 133 so that the folding rods 123 are angled to each other, and individually angled relative to the mounting rod 111. The two lateral seat segments 132 and the main seat segment 131 are in line with each other and are angled relative to the mounting rod 111, which allows a user to be seated on the conventional foldable chair. When the seat unit 13 and the folding unit 12 is moved to be in the folded state (not shown), the main seat segment 131 and the two lateral seat segments 132 are substantially parallel to the mounting rod 111, the upper slide base 122 is more distal from the positioning base 121, and the top ends of the folding rods 123 are close to each other and are respectively positioned at the collapsed end points 135 of the guide rails 133.

Although the conventional foldable chair has folding functionality, when the user operates the upper slide base 122 to move along the mounting rod 111 to convert the seat unit 13 and the folding unit 12 from the folded state to the expanded state, the top ends of the folding rods 123 may get stuck when moving from the collapsed end points 135 toward the expanded end points 134, and the user may need to expend extra effort to manually guide the top ends of the of the folding rods 123 to facilitate movement to the expanded end points 134. This would be very inconvenient for the user of the conventional foldable chair. Additionally, sometimes the user may sit on the conventional foldable chair when the top ends of the folding rods 123 are stuck between the expanded end points 134 and the collapsed end points 135, and the conventional foldable chair is still unstable. This may be very dangerous for the user as the user may fall off the conventional foldable chair and sustain an injury.

SUMMARY

Therefore, an object of the disclosure is to provide a foldable chair that can alleviate at least one of the drawbacks of the prior art.

According to the disclosure, the foldable chair includes a support unit, a sliding base, and a seat unit. The support unit includes a pivot base, a main support rod that is pivotally connect to and that extends through the pivot base, and at least two auxiliary support rods that are pivotally connected to and that extends through the pivot base. The sliding base is slidably sleeved on the main support rod. The seat unit includes a seating subunit that is connected to the sliding base, and a linkage subunit. The linkage subunit includes a first linkage rod pivotally connected to the pivot base, a second linkage rod having opposite ends that are respectively and pivotally connected to the first linkage rod and the sliding base, and a resilient member disposed between the pivot base and the first linkage rod. The seating subunit is convertible, via movement of the sliding base and the linkage module, between a folded state, where the seating subunit is folded to be substantially parallel to the main support rod, and where the first and second linkage rods are substantially parallel to the main support rod, and an expanded state, where the seating subunit is expanded to be transverse to the main support rod, and where an end of the first linkage rod that is distal from the pivot base supports the seating subunit thereon for positioning the seating subunit relative to the main support rod. The resilient member is disposed for biasing the end of the first linkage rod that is distal from the pivot base away from the main support rod.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
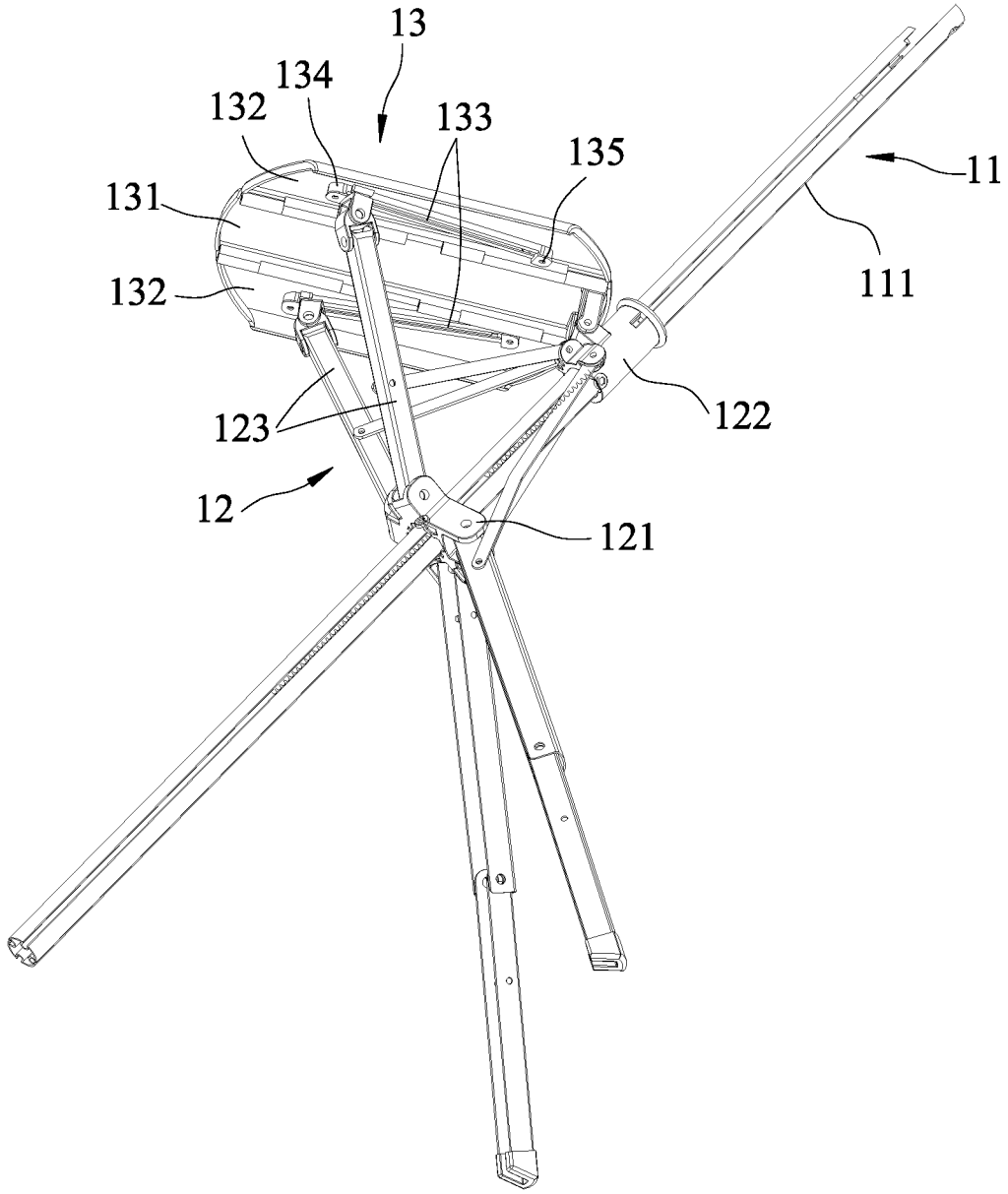
FIG.1 PRIOR ART
FIG. 1 is a perspective view illustrating a conventional foldable chair.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
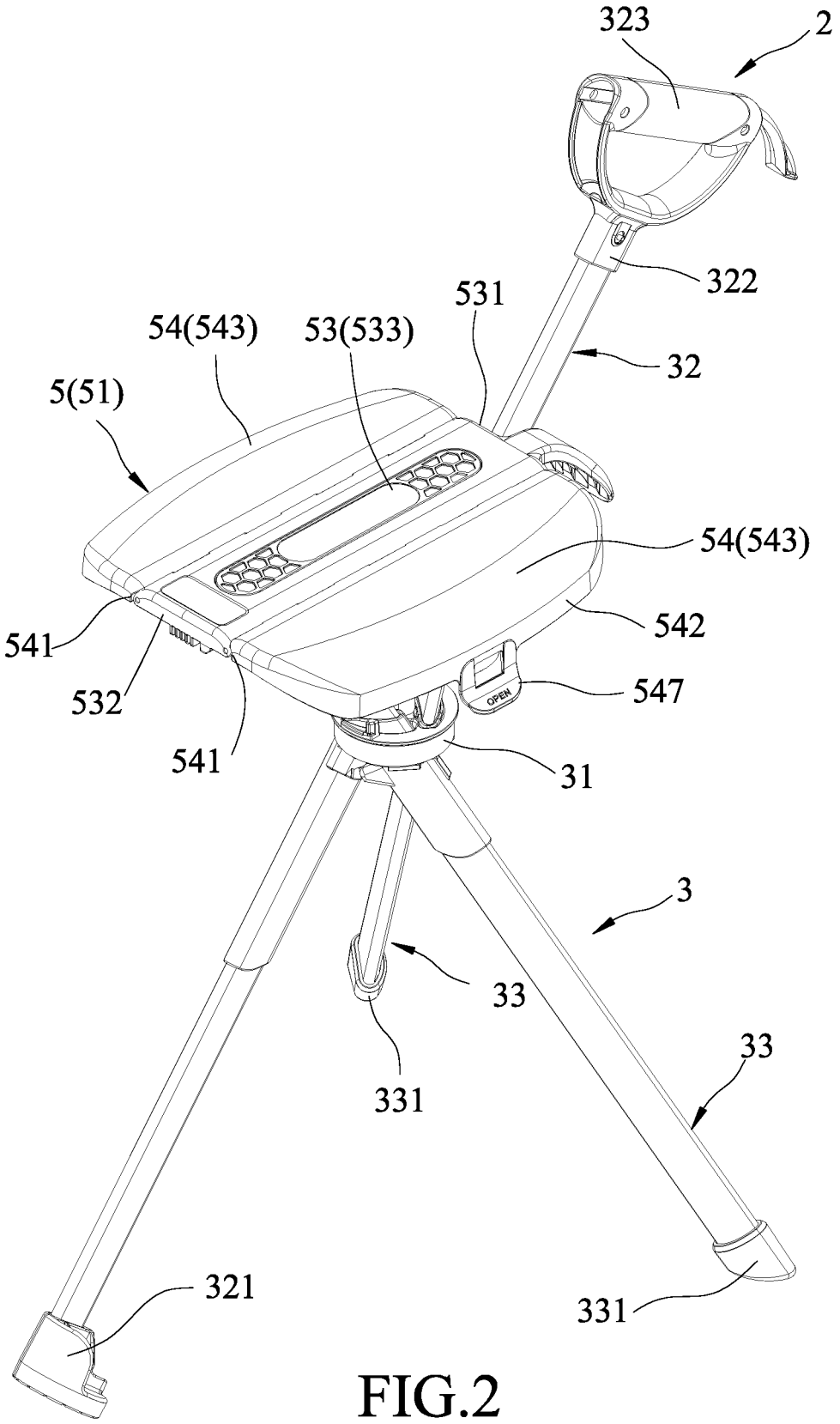
FIG. 2 is a perspective view illustrating an embodiment of a foldable chair according to the present disclosure.
Figure 3:
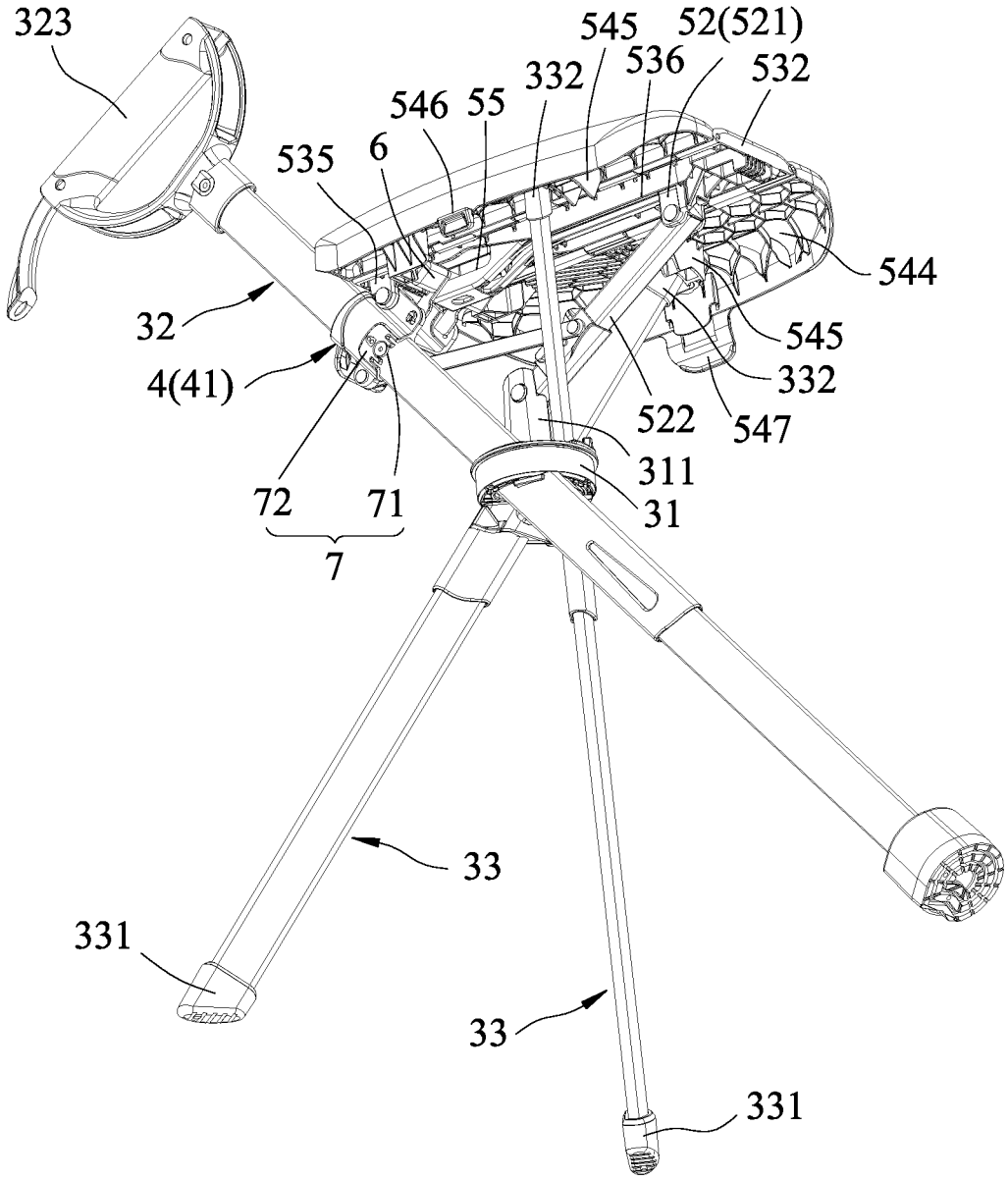
FIG. 3 is a perspective view illustrating the embodiment from another angle.

Referring to FIGS. 2, and 3, an embodiment of a foldable chair 2 according to the present disclosure includes a support unit 3, sliding base 4, a seat unit 5, an actuating member 6, and a positioning unit 7.

The support unit 3 includes a pivot base 31, a main support rod 32 that is pivotally connected to and that extends through the pivot base 31, and at least two auxiliary support rods 33 that are pivotally connected to and that extends through the pivot base 31. The pivot base 31 has a pivot post 311 that extends upwardly. The main support rod 32 has a main rod bottom end 321, a main rod top end 322 that is opposite to the main rod bottom end 321, and a handle 323 that is mounted on the main rod top end 322. In this embodiment, there are two auxiliary support rods 33 and each of the auxiliary support rods 33 has an auxiliary rod bottom end 331, and an auxiliary rod top end 332 that is opposite to the auxiliary rod bottom end 331.

Figure 5:
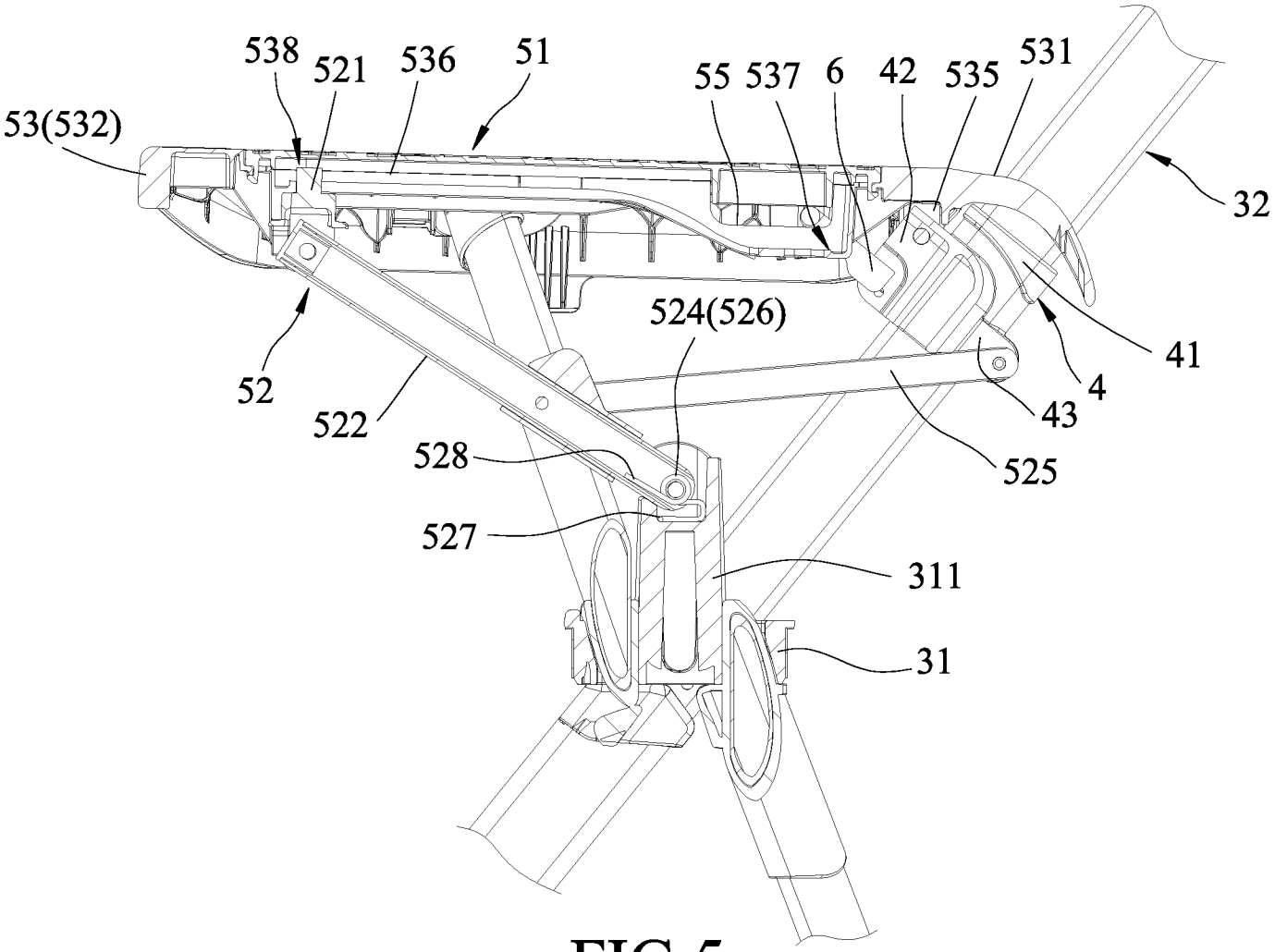
FIG. 5 is a fragmentary partly cross-sectional view of the embodiment, illustrating a seating subunit in the expanded state.

Referring to FIG. 5, the sliding base 4 is slidably sleeved on the main support rod 32. The sliding base 4 includes a sleeve 41 that is movably sleeved on the main support rod 32, a pivot lug 43 that extends laterally from a side of the sleeve 41, and a pivot block 42 that extends laterally from an opposite side of the sleeve 41.

Figure 8:
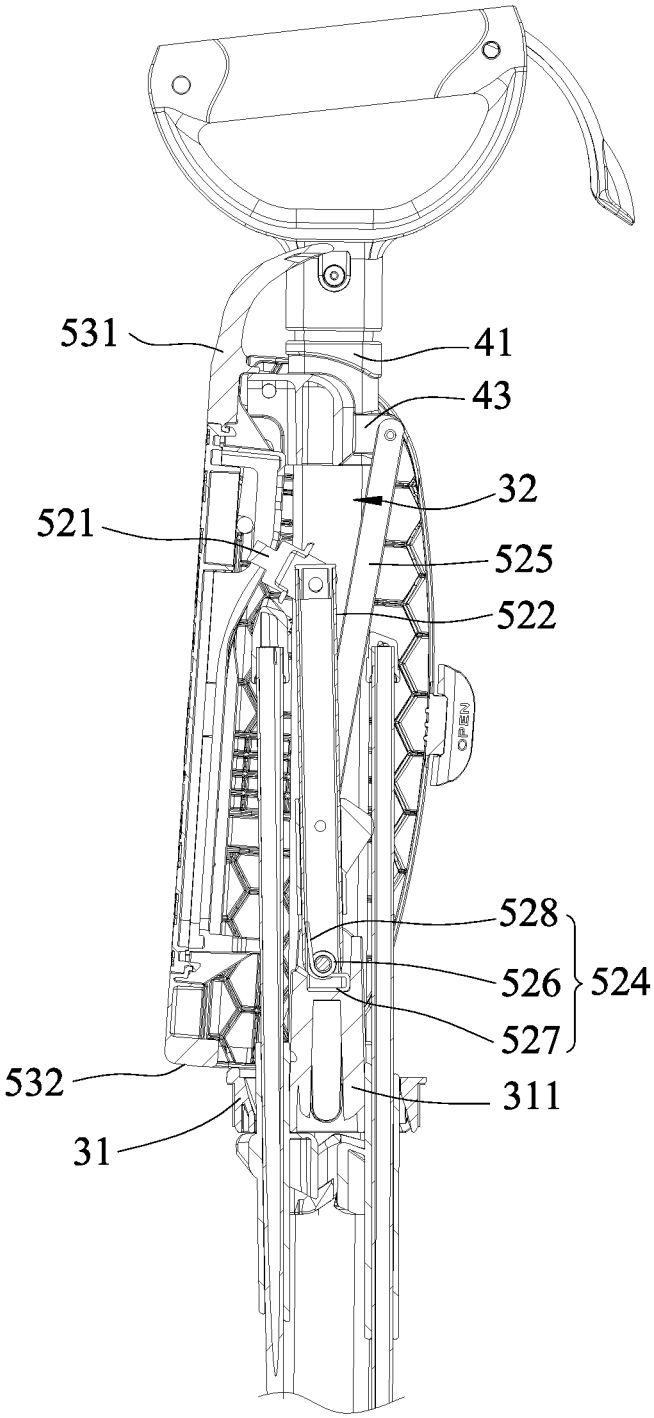
FIG. 8 is a fragmentary cross-sectional view illustrating the seating subunit in the folded state.

Referring to FIGS. 2 to 5, the seat unit 5 includes a seating subunit 51 that is connected to the sliding base 4, and a linkage module 52 that is connected to the pivot post 311 of the pivot base 31 to form a pivot connection and that is linked with the seating subunit 51. The seating subunit 51 of the seat unit 5 has a main seat member 53 that is pivotally connected to the pivot block 42, two lateral seat members 54 that are respectively and pivotally connected to two opposite sides of the main seat member 53, and a guide portion 55 that is disposed on the main seat member 53. The seating subunit 51 is convertible, via movement of the sliding base 4 and the linkage module 52, between a folded state (as shown in FIG. 8), where the seating subunit 51 is folded to be substantially parallel to the main support rod 32, and an expanded state (as shown in FIG. 5), where the seating subunit 51 is expanded to be transverse to the main support rod 32.

The main seat member 53 of the seat unit 5 has a first end portion 531, a second end portion 532, a main support surface 533, a main bottom surface 534, a pair of pivot plates 535, and a guide rail 536. The first end portion 531 is proximate to the main support rod 32. The second end portion 532 is opposite to the first end portion 531. The main support surface 533 extends from the first end portion 531 to the second end portion 532. The main bottom surface 534 is opposite to the main support surface 533 (see FIG. 7). The pair of pivot plates 535 are located on the first end portion 531 and are pivotally connected to the pivot block 42. The guide rail 536 is recessed from and extending lengthwise along the main bottom surface 534 of the main seat member 53 of the seating subunit 51, and has a T-shaped cross section. The guide rail 536 has a folded state end point 537 that is located proximate to the sliding base 4 and the first end portion 531, and an expanded state end point 538 that is located distal from the sliding base 4 and proximate to the second end portion 532.

Each of the lateral seat members 54 of the seat unit 5 has an inner lateral side 541, an outer lateral side 542, a lateral support surface 543, a lateral bottom surface 544, and a blocking piece 545. The inner lateral side 541 is adjacent to the main seat member 53. The outer lateral side 542 is opposite to the inner lateral side 541. The lateral support surface 543 extends from the inner lateral side 541 to the outer lateral side 542. The lateral bottom surface 544 is opposite to the lateral support surface 543. The auxiliary rod top ends 332 of the auxiliary support rods 33 respectively abut against the lateral bottom surfaces 544 of the lateral seat members 54 when the seating subunit 51 is in the expanded state. The blocking piece 545 of each of the lateral seat members 54 is formed on the lateral bottom surface 544, is adjacent to the outer lateral side 542, and engages the auxiliary rod top end 332 of the respective one of the auxiliary support rods 33 for restraining movement of the auxiliary support rod 33 when the seating subunit 51 is in the expanded state. Furthermore, one of the lateral seat members 54 of the seat unit 5 further has a buckle member 546 that is disposed on the outer lateral side 542 thereof, and the other one of the lateral seat members 54 further has a clasp member 547 that is disposed on the outer lateral side 542 thereof and that engages the buckle member 546 when the seating subunit 51 is in the folded state.

The guide portion 55 is a slide rail that is parallel to the main support surface 533, and that is proximate to the first end portion 531 of the main seat member 53.

Figure 4:
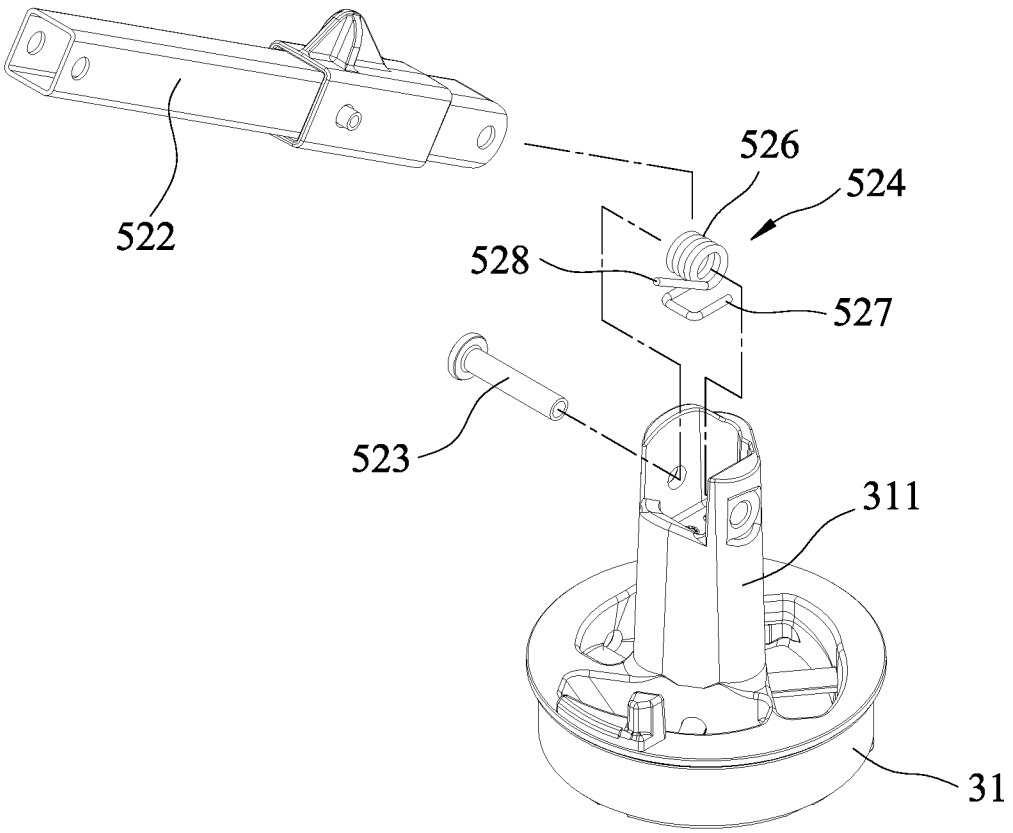
FIG. 4 is an exploded perspective view illustrating a pivot base, a pin, a resilient member and a first linkage rod of the embodiment.
Figure 6:
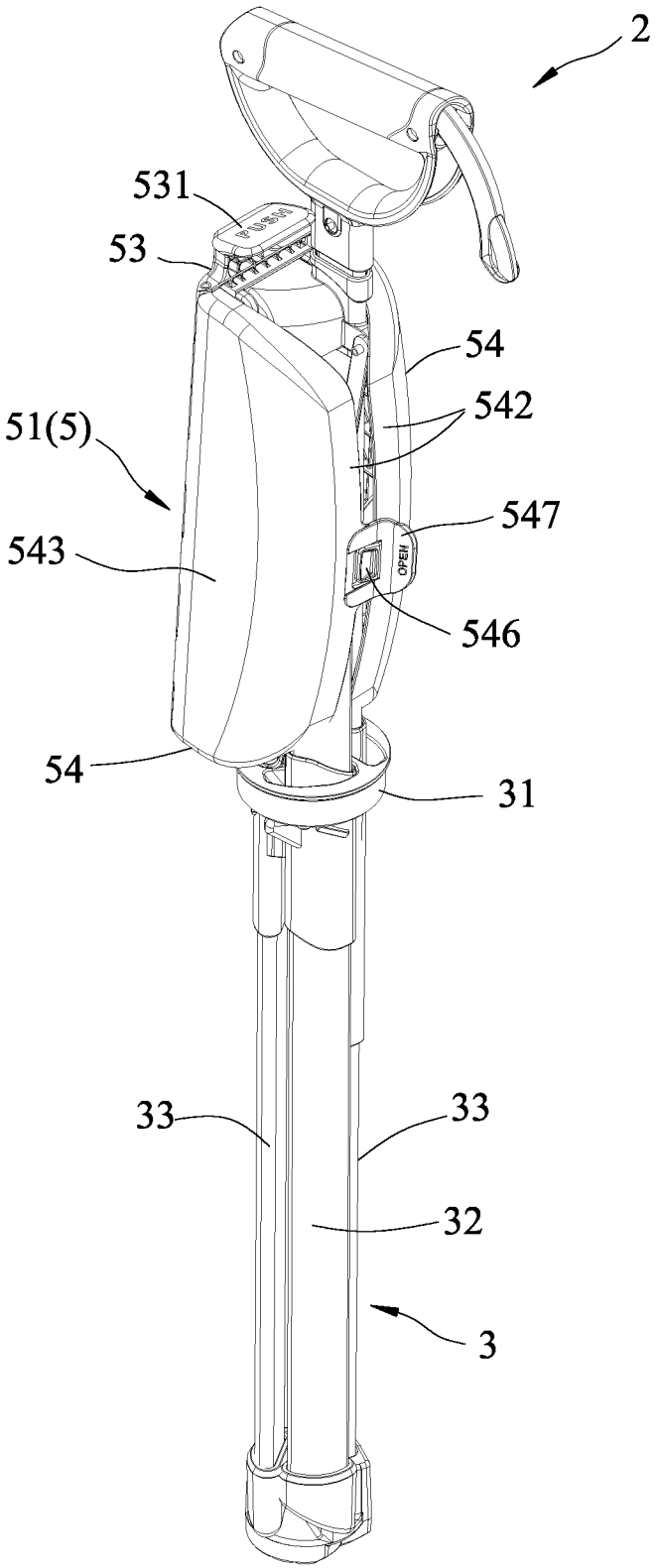
FIG. 6 is a perspective view illustrating the seating subunit in a folded state.
Figure 7:
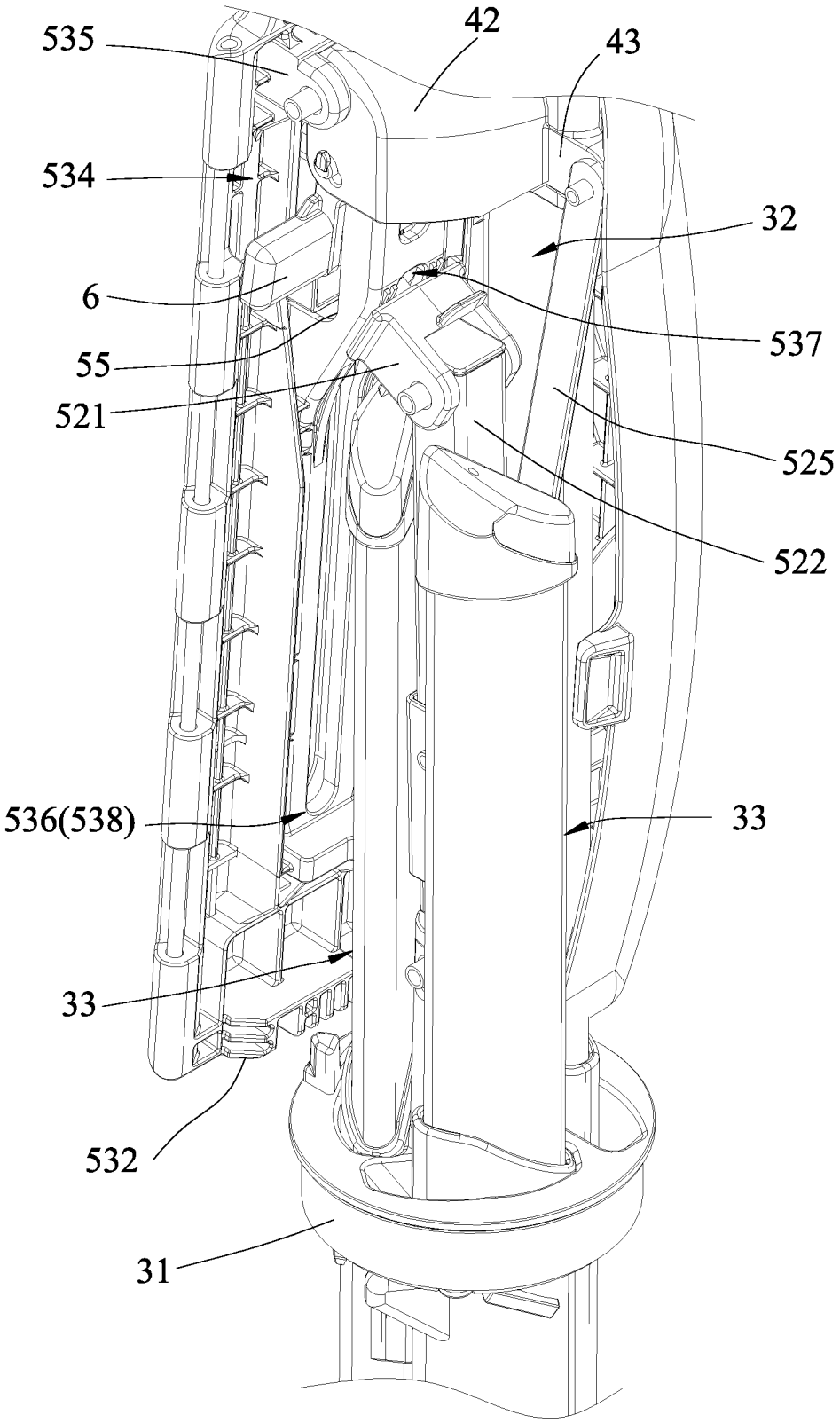
FIG. 7 is an enlarged fragmentary perspective view showing the seating subunit in the folded state.

Referring to FIGS. 4 and 5, the linkage module 52 includes a slide block 521, a first linkage rod 522, a pin 523, a resilient member 524, and a second linkage rod 525. The slide block 521 is connected to an end of the first linkage rod 522 distal from the pivot base 31, and is slidable along the guide rail 536. The first linkage rod 522 is pivotally connected to the pivot post 311 of the pivot base 31. The pin 523 extends through the pivot post 311 and the first linkage rod 522 to form a pivot connection. The resilient member 524 is disposed between the pivot post 311 of the pivot base 31 and the first linkage rod 522, and is disposed for biasing an end of the first linkage rod 522 that is distal from the pivot base 31 away from the main support rod 32, and for biasing the slide block 521 toward the expanded state end point 538 of the guide rail 536. The second linkage rod 525 has opposite ends that are respectively and pivotally connected to the first linkage rod 522 and the pivot lug 43 of the sliding base 4. The resilient member 524 is a torsion spring and has a main body 526 that has two opposite ends and that is sleeved on the pin 523, a first leg member 527 that is connected to one end of the main body 526 and that resiliently abuts against the pivot post 311, and a second leg member 528 that is connected to the other end of the main body 526 and that resiliently abuts against an inner wall of the first linkage rod 522. Referring to FIGS. 6 to 8, when the seating subunit 51 is in the folded state, the slide block 521 is at the folded state end point 537 of the guide rail 536, the first and second linkage rods 522, 525 are substantially parallel to the main support rod 32, and the main body 526 of the resilient member 524 resiliently biases the first linkage rod 522 with a torque force that urges the first linkage rod 522 to pivot away from the main support rod 32. When the seating subunit 51 is in the expanded state, the slide block 521 is at the expanded state end point 538 of the guide rail 536, and an end of the first linkage rod 522 that is distal from the pivot base 31 supports the seating subunit 51 thereon for positioning the seating subunit 51 relative to the main support rod 32.

Referring to FIG. 5, the actuating member 6 has two opposite ends, one end is pivotally connected to the pivot block 42 of the sliding base 4, and the other end is slidably connected to the guide portion 55 of the seat unit 5.

Referring to FIG. 3, the positioning unit 7 includes a first engaging portion 71 that is disposed on the main support rod 32, and a second engaging portion 72 that is disposed on the sliding base 4. More specifically, the first and second engaging portions 71, 72 are male and female matching components. When the seating subunit 51 is in the folded state, the first engaging portion 71 and the second engaging portion 72 are disengaged from each other. When the seating subunit 51 is in the expanded state, the first engaging portion 71 engages the second engaging portion 72.

Referring to FIGS. 6 to 8, when the seating subunit 51 is in the folded state, the main support rod 32 and the auxiliary support rods 33 are positioned close together and substantially parallel to each other, the first and second linkage rods 522, 525 are substantially parallel to the main support rod 32, and the seat unit 5 and the support unit 3 are close together. Additionally, the second end portion 532 of the main seat member 53 is proximate to the pivot base 31, and the two lateral seat members 54 are respectively pivoted such that the main seat member 53 and the lateral seat members 54 cooperatively surround the main support rod 32, the auxiliary support rods 33 and the first and second linkage rods 522, 525. The slide block 521 is at the folded state end point 537, and the first and second linkage rods 522, 525 are substantially parallel to the main support rod 32. Furthermore, the first linkage rod 522 and the pivot post 311 compress the main body 526 of the resilient member 524 by respectively biasing the second leg member 528 and the first leg member 527 so that the main body 526 is loaded with a restoring force that continuously biases the second leg member 528 against the first linkage rod 522, thereby generating a torque force that urges the end of the first linkage rod 522 that is distal to the pivot base 31 to pivot away from the main support rod 32 and bring and urge the slide block 521 to slide toward the expanded state end point 538. Additionally, in the folded state, the clasp member 547 may engage the buckle member 546 so that the foldable chair 2 may be secured in the folded state, and fix the seating subunit 51 so that it is in a roughly U-shape and allow the foldable chair 2 to stably remain in the folded state.

Figure 9:
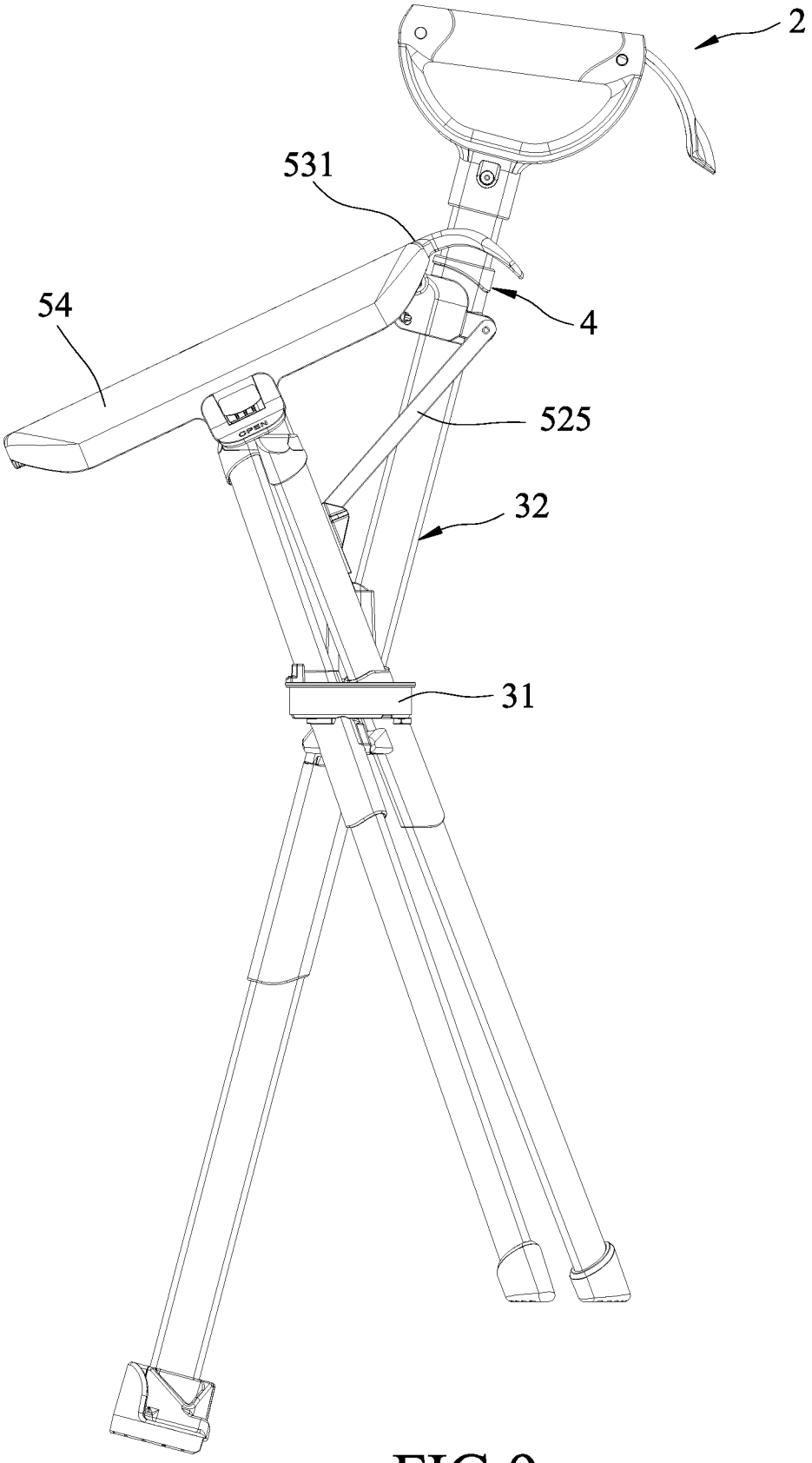
FIG. 9 is a side view illustrating the seating subunit between the expanded state and the folded state.
Figure 10:
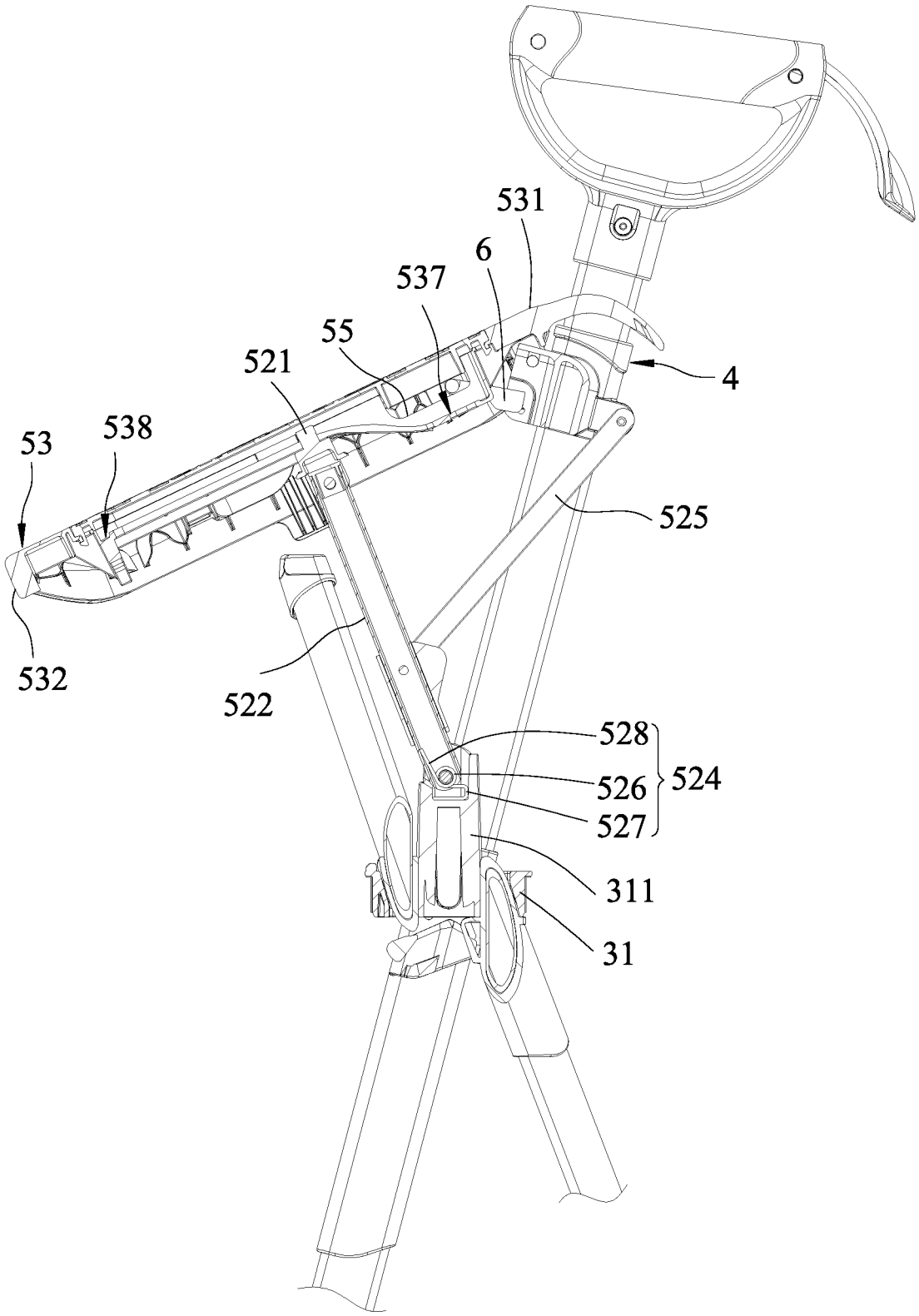
FIG. 10 is a fragmentary cross-sectional view illustrating the seating subunit between the expanded state and the folded state.

When the user disengages the clasp member 547 from the buckle member 546, and pushes the first end portion 531 of the main seat member 53 lightly, the restoring force stored in the main body 526 of the resilient member 54 will bias the first linkage rod 522 via the second leg member 528 which will urge the slide block 521 to slide toward the expanded state end point 538. Referring to FIGS. 9 and 10, when the slide block 521 slides from the folded state end point 537 toward the expanded state end point 538, the main seat member 53, and the second end potion 532 of the main seat member 53 move away from the pivot base 31, the main seat member 53 will pivot relative to the sliding base 4. Additionally, since the two opposite ends of the actuating member 6 are respectively and pivotally connected to the pivot block 42, and slidably connected to the guide portion 55, the actuating seat 6 can pivot while sliding relative to the guide portion 55, which drives the lateral seat members 54 to pivot relative to the main seat member 53 so that the lateral seat members 54 line up with the main seat member 53. Furthermore, the auxiliary rod top end 332 of each of the auxiliary support rods 33 will respectively abut against the lateral bottom surface 544 of the respective one of the lateral seat members 54 when the seating subunit 51 reaches the expanded state, and be restrained by the respective blocking piece 545 (see FIG. 3) of the respective one of the lateral seat members 54 to keep the lateral seat member 54 in line with the main seat member 53 and prevent the lateral seat member 54 from pivoting away, thereby stabilizing the seating subunit 51 in the expanded state. In this state, the second engaging portion 72 of the positioning unit 7 that is disposed on the sliding base 4, and the first engaging portion 71 that is disposed on the main support rod 32 are engaged and provide additional stability to the seating subunit 51 so that the seating subunit 51 does not move relative to the main support rod 32.

Conversely, when the user wishes to convert the seating subunit 51 form the expanded state into the folded state, the user pulls the first end portion 531 of the main seat member 53 to drive the sliding base 4 to slide upwardly along the main support rod 32. When the sliding base 4 slides upwardly, the second linkage rod 525 will drive the first linkage rod 522 and the slide block 521, and cause the slide block 521 to move from the expanded state end point 538 towards the folded state end point 537 so that the second end point 532 of the main seat member 53 gradually moves closer to the pivot base 31, and cause the first engaging portion 71 to be disengaged from the second engaging portion 72. Thus the seating subunit 51 will be converted from the expanded state (as shown in FIGS. 3 and 5) into the folded state (as shown in FIGS. 6 and 8).

The above description provides a brief overview of the conversion of the seating subunit 51 between the folded state and the expanded state, and the action of the actuating member 6. However, a more detailed account of the same is disclosed in Taiwanese Invention Patent No. I736504, and further details are omitted herefrom.

In summary, in the foldable chair according to the present disclosure, by virtue of the resilient member 524 being disposed between the pivot post 311 of the pivot base 31 and the first linkage rod 522, when the seating subunit 51 is in the folded state, the first linkage rod 522 and the pivot post 311 compress the main body 526 of the resilient member 524 by respectively biasing the second leg member 528 and the first leg member 527 so that the main body 526 is loaded with a restoring force that causes the second leg member 528 to bias the first linkage rod 522. Therefore, after the user disengages the buckle member 546 and the clasp member 547, the user will only need to lightly push downwardly on the first end portion 531 of the main seat member 53 to release the restoring force in the compressed main body 526 which will cause the second leg member 528 to push the first linkage rod 522 to urge the slide block 521 to slide towards the expanded state end point 538. This allows the seating subunit 51 to smoothly convert from the folded state to the expanded state.

Additionally, it should be noted that, in other embodiments of the disclosure, the guide rail 536 and the sliding block 521 may be omitted. In this case, when the seating subunit 51 is converted from the folded state to the expanded state, the restoring force in the compressed main body 526 of the resilient member 524 will cause the second leg member 528 to push the end of the first linkage rod 522 that is distal from the pivot base 31 to move away from the main support rod 32. Additionally, since the first linkage rod 522 is connected to the second linkage rod 525, the movement of the first linkage rod 522 will cause the sliding base 4 which is connected to the second linkage rod 525 to slide on the main support rod 32 until the first engaging portion 71 engages the second engaging portion 72. At this point the first linkage rod 522 is restricted by the second linkage rod 525, and the end of the first linkage rod 522 that is distal form the main support rod 32 will abut against main bottom surface 534 of main seat member 53 so that the seating subunit 51 can remain in the expanded state.

In summary of the above, the foldable chair 2 according to the present disclosure is easy to operate and is able to remain stable when the seating subunit 51 is in the expanded sate.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A foldable chair comprising:

a support unit including a pivot base, a main support rod that is pivotally connected to and that extends through said pivot base, and at least two auxiliary support rods that are pivotally connected to and that extends trough said pivot base;

a sliding base slidably sleeved on said main support rod; and a seat unit including a seating subunit that is pivotally connected to said sliding base, and a linkage subunit that includes a first linkage rod pivotally connected to said pivot base and pivotally connected to said seating subunit, said first linkage rod having an end that is opposite to said pivot base, said linkage subunit further including a second linkage rod having opposite ends that are respectively and pivotally connected to said first linkage rod and said sliding base, and a resilient member disposed between said pivot base and said first linkage rod;

wherein via pivot movement between said seating subunit and said sliding base, pivot movement between said first linkage rod and said pivot base, pivot movement between said first linkage rod and said seating subunit, and sliding movement of said sliding base relative to said main support rod, said seating subunit is convertible between a folded state, where said seating subunit is folded to be substantially parallel to said main support rod, and where said first and second linkage rods are substantially parallel to said main support rod, and an expanded state, where said seating subunit is expanded to be transverse to said main support rod, and where said first linkage rod supports said seating subunit thereon for positioning said seating subunit relative to said main support rod; and wherein said resilient member is disposed for biasing said end of said first linkage rod away from said main support rod.

2. The foldable chair as claimed in claim 1, wherein:

said pivot base has a pivot post that extends upwardly, said first linkage rod being pivotally connected to said pivot post;

said linkage subunit further includes a pin that extends through said pivot post and said first linkage rod to form a pivot connection; and said resilient member is a torsion spring and has a main body that has two opposite ends and that is sleeved on said pin, a first leg member that is connected to one end of said main body and that resiliently abuts against said pivot post, and a second leg member that is connected to the other end of said main body and that resiliently abuts against an inner wall of said first linkage rod.

3. The foldable chair as claimed in claim 1, wherein:

said seating subunit of said seat unit has a guide rail that extends lengthwise along a bottom surface of said seating subunit, and said guide rail has a folded state end point located proximate to said sliding base, and an expanded state end point located distal from said sliding base;

said linkage subunit further includes a slide block that is connected to said end of said first linkage rod and that is slidable along said guide rail;

when said seating subunit is in said folded state, said slide block is at said folded state end point;

when said seating subunit is in said expanded state, said slide block is at said expanded state end point; and said resilient member is disposed for biasing said slide block toward said expanded state end point.

4. The foldable chair as claimed in claim 1, wherein:

said sliding base includes a sleeve that is movably sleeved on said main support rod, and a pivot lug that extends laterally from a side of said sleeve; and said opposite ends of said second linkage rod are respectively and pivotally connected to said first linkage rod and said pivot lug.

5. The foldable chair as claimed in claim 4, wherein:

said sliding base further includes a pivot block that extends laterally from an opposite side of said sleeve; and said seating subunit of said seat unit has a main seat member that is pivotally connected to said pivot block, and two lateral seat members that are respectively and pivotally connected to two opposite sides of said main seat member.

6. The foldable chair as claimed in claim 5, wherein said main seat member of said seat unit has a first end portion that is proximate to said main support rod, and a second end portion that is opposite said first end portion, a main support surface that extends from said first end portion to said second end portion, a main bottom surface that is opposite to said main support surface, and a pair of pivot plates that are located on said first end portion and that are pivotally connected to said pivot block.

7. The foldable chair as claimed in claim 5, wherein each of said lateral seat members of said seat unit has:

an inner lateral side that is adjacent to said main seat member;

an outer lateral side that is opposite to said inner lateral side;

a lateral support surface that extends from said inner lateral side to said outer lateral side;

a lateral bottom surface that is opposite to said lateral support surface, a top end of one of said at least two auxiliary support rods abutting against said lateral bottom surface when said seating subunit is in the expanded state; and a blocking piece that is formed on said lateral bottom surface, that is adjacent to said outer lateral side, and that restrains movement of said one auxiliary support rod when said seating subunit is in the expanded state.

8. The foldable chair as claimed in claim 7, wherein one of said lateral seat members of said seat unit further has a buckle member that is disposed on said outer lateral side thereof, and the other one of said lateral seat members further has a clasp member that is disposed on said outer lateral side thereof and that engages said buckle member when said seating subunit is in the folded state.

* * * * *